US005336058A

United States Patent [19]

Yokoyama

[11] Patent Number: 5,336,058

[45] Date of Patent: Aug. 9, 1994

[54] SCROLL-TYPE COMPRESSOR WITH VARIABLE DISPLACEMENT MECHANISM

[75] Inventor: Hiroyuki Yokoyama, Takasaki, Japan

[73] Assignee: Sanden Corporation, Isesaki, Japan

[21] Appl. No.: 19,281

[22] Filed: Feb. 18, 1993

[30] Foreign Application Priority Data

Feb. 18, 1992 [JP] Japan ..... 4-030664

[51] Int. Cl.[5] ..... F04C 18/02

[52] U.S. Cl. ..... 417/299; 417/440; 418/55.1

[58] Field of Search ..... 417/299, 310, 440; 418/55.2, 55.1

[56] References Cited

U.S. PATENT DOCUMENTS

| | | | |
|---|---|---|---|
| 3,759,057 | 9/1973 | English et al. . | |
| 4,383,805 | 5/1983 | Teegarden et al. | 417/440 X |
| 4,459,817 | 7/1984 | Inagaki | 417/299 X |
| 4,505,651 | 3/1985 | Terauchi et al. | 417/440 |
| 4,642,034 | 2/1987 | Terauchi . | |
| 4,717,314 | 1/1988 | Sato et al. . | |
| 4,744,733 | 5/1988 | Terauchi et al. . | |
| 4,747,756 | 5/1988 | Sato et al. . | |
| 4,846,633 | 7/1989 | Suzuki et al. | 417/440 X |
| 4,890,987 | 2/1990 | Sato et al. . | |
| 4,904,164 | 2/1990 | Mabe et al. . | |
| 4,940,395 | 7/1990 | Yamamoto et al. . | |
| 5,059,098 | 10/1991 | Suzuki et al. . | |

FOREIGN PATENT DOCUMENTS

| | | | |
|---|---|---|---|
| 0144169 | 6/1985 | European Pat. Off. . | |
| 0297840 | 1/1989 | European Pat. Off. . | |
| 1035170 | 7/1958 | Fed. Rep. of Germany | 417/299 |
| 3804418 | 10/1988 | Fed. Rep. of Germany . | |
| 60-101295 | 6/1985 | Japan . | |
| 62-91680 | 4/1987 | Japan | 417/440 |
| 63-212789 | 9/1988 | Japan . | |
| 1-106990 | 4/1989 | Japan | 417/310 |
| 1-318777 | 12/1989 | Japan | 417/299 |
| 3-92592 | 4/1991 | Japan | 417/310 |

*Primary Examiner*—Richard E. Gluck
*Attorney, Agent, or Firm*—Baker & Botts

[57] ABSTRACT

A variable displacement, scroll-type compressor comprising a housing having fluid inlet and outlet ports. A fixed scroll member, placed within the housing, comprises a first plate from which a first spiral element extends. An orbiting scroll member comprises a second plate from which a second spiral element extends. A pair of holes are formed through said first plate. A pair of bypass passages place intermediately located sealed-off fluid pockets in communication with a suction chamber. A pair of cylinders are formed within respective bypass passages. A valve member having a first and a second axial end is slidably disposed within each of the cylinders so as to close and open the corresponding bypass passage. A spring is disposed within the cylinder so as to urge the valve member to open the bypass passage. The valve member receives pressure at its first axial end from the intermediately located sealed-off fluid pocket. A three-way electromagnetic valve selectively controls communication between the second axial end of the valve member and either the suction chamber or the discharge chamber.

8 Claims, 7 Drawing Sheets

Ps
Pm
Pc
Pd
23
42
42a
41
60a
60b
60
70
50
14
90
7
15
2
80
83
92
81
82
91
A
B

SCROLL-TYPE COMPRESSOR WITH VARIABLE DISPLACEMENT MECHANISM

BACKGROUND OF THE INVENTION

1. Field of the Invention

The invention relates to an improved scroll-type compressor and more particularly, to an improved scroll-type compressor with a variable displacement mechanism.

2. Description of the Prior Art

A scroll-type compressor which can vary the compression ratio is well known in the art. A scroll-type compressor with a variable displacement mechanism is depicted in FIGS. 1(*a*) and 1(*b*). This compressor's variable displacement mechanism is similar to the variable displacement mechanism described in Japanese Utility Model Application Publication No. 63-177688.

As depicted in FIGS. 1(*a*) and 1*b*), a bypass passage 40 includes a bypass hole 41 formed in a first plate 11 of a fixed scroll member 10, and a side bypass passage 42 which also is formed in first plate 11 and extends in a radial direction to first plate 11. A cylinder 50 is coaxial with side bypass passage 42, and, therefore, a shuttle valve member 60, which is slidably disposed in cylinder 50 and side bypass passage 42, is also coaxial with side bypass passage 42. In addition, a spring 70 biasing shuttle valve member 60 is disposed in side bypass passage 42.

The pressure in cylinder 50 is controlled by adjusting pressure applied against an end 60*a* of shuttle valve member 60. The position of shuttle valve member 60 is controlled for opening and closing bypass passage 40 by utilizing the relationship between the adjusted pressure applied against end 60*a* and the force of spring 70 biasing shuttle valve member 60.

For this purpose, the compressor in FIGS. 1(*a*) and 1(*b*) is provided with a discharge pressure (Pd) passage 103 for introducing fluid from a discharge chamber (not shown) into cylinder 50, and is also provided with a suction pressure (Ps) passage 104 for returning the fluid in cylinder 50 to a suction chamber 29. An orifice 105 is provided in Pd passage 103, so that a reduced Pd is always introduced into cylinder 50. Meanwhile, a device for controlling the pressure (not shown) between Ps passage 104 and Pd passage 103 is provided in Ps passage 104. This device selectively opens and closes Ps passage 104 to adjust the displacement of the compressor.

Therefore, the force applied to opposite ends 60*a* and 60*b* of shuttle valve member 60 has the relationship set forth below. When Ps passage 104 is opened, the end of cylinder 50 nearest Ps passage 104 is placed in communication with suction chamber 29, the fluid in cylinder 50 immediately flows through Ps passage 104 into suction chamber 29. The displacement of the compressor, thus, changes from the maximum to the minimum value. Assuming that:

Pc is the control pressure introduced into cylinder 50,
Pm is the pressure of the fluid being compressed in a fluid pocket (not shown),
Pd is the discharge pressure,
Ps is the suction pressure, and
F is the spring force of spring 70;
p is the difference between the forces applied to opposite ends 60*a* and 60*b* of shuttle valve member 60 and is expressed as follows:

$$P=Pc-Ps+F.$$

Consequently, when Pc=Ps, only spring force F acts to open shuttle valve member 60. This results in a problem relating to the responsiveness of shuttle valve member 60 in cylinder 50.

In this configuration, when the movement of shuttle valve member 60 opens bypass passage 40, the fluid which is compressed in the fluid pocket immediately returns through bypass passage 40 to suction chamber 29. Therefore, when shuttle valve member 60 opens bypass passage 40, the fluid, passes over end 60*b* of shuttle valve member 60 and immediately flows through bypass passage 40 into suction chamber 29. Thus, end 60*b* of shuttle valve member 60 receives little pressure from the compressed fluid. Further, because spring 70 for biasing shuttle valve member 60 open is disposed in bypass passage 40, spring 70 causes a pressure loss when the fluid flows through bypass passage 40 into suction chamber 29.

SUMMARY OF THE INVENTION

It is an object of this invention to provide a variable displacement, scroll-type compressor which has superior responsiveness in the displacement control of the compressor.

It is another object of the present invention to provide a variable displacement, scroll-type compressor which can obtain minimum displacement.

According to the present invention, a variable displacement, scroll-type compressor comprises a housing having a fluid inlet port and a fluid outlet port, a fixed scroll member having a first plate and a first spiral element extending from a first face of the first plate. It further comprises a discharge port formed at a central portion of the first plate. The fixed scroll member is fixedly disposed in the housing. The compressor also comprises an orbiting scroll member having a second plate and a second spiral element which extends from a first face of the second plate, such that the first spiral element engages the second spiral element to form a plurality of sealed-off fluid pockets. A driving mechanism causes an orbital motion of the orbiting scroll member, and a rotation-preventing mechanism prevents the rotation of the orbiting scroll member during its orbital motion, whereby the volumes of the sealed-off fluid pockets are varied.

The compressor also comprises a suction chamber formed between an outer peripheral surface, which is itself formed by the fixed scroll member and the orbiting scroll member, and an inner peripheral surface of the housing, which is in communication with the fluid inlet port. In addition, it comprises a discharge chamber which is in communication with the discharge port and the fluid outlet port.

The compressor further comprises at least one bypass passage which places at least one corresponding, intermediately located sealed-off fluid pocket in communication with said suction chamber; at least one cylinder corresponding to at least one bypass passage and formed within the at least one bypass passage; at least one valve member corresponding to at least one bypass passage, having a first and a second axial end, and slidably disposed within the at least one cylinder; and an elastic member biasing the at least one corresponding valve member to urge the at least one valve member to open the at least one bypass passage.

The at least one cylinder is located, so that the at least one valve member receives pressure from at least one intermediately located sealed-off fluid pocket at said first axial end thereof. The compressor further comprises communication control means, such as a three-way electromagnetic valve, for selectively controlling a first communication passage between said suction chamber and a cavity defined by the second axial end of the valve member and at least one cylinder and a second communication passage between the discharge chamber and the cavity.

Other objects, features, and advantages of this invention will be apparent when the detailed description of the invention and the drawings are considered.

BRIEF DESCRIPTION OF THE DRAWINGS

FIG. 1(*a*) depicts an open bypass passage, and FIG. 1(*b*) depicts a closed bypass passage.

FIG. 8(*a*) depicts a closed bypass passage, and FIG. 8(*b*) depicts an enlarged view of the three-way electromagnetic valve of FIG. 8(*a*).

FIG. 9(*a*) depicts an open bypass passage, and FIG. 9(*b*) depicts an enlarged view of the three-way electromagnetic valve of FIG. 9(*a*).

DETAILED DESCRIPTION OF THE INVENTION

Figure 1B:
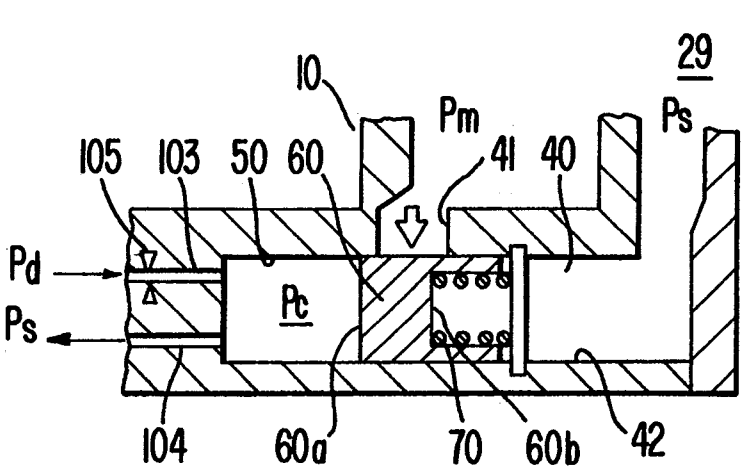
FIG. 1(b) (PRIOR ART)
FIG. 1 is a cross sectional view of principal parts of a variable displacement, scroll-type compressor in the prior art.
Figure 1A:
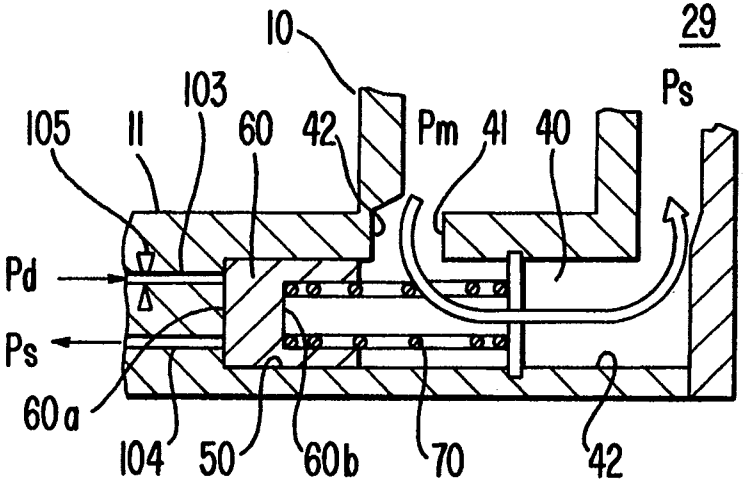
FIG. 1(a) (PRIOR ART)
Figure 2:
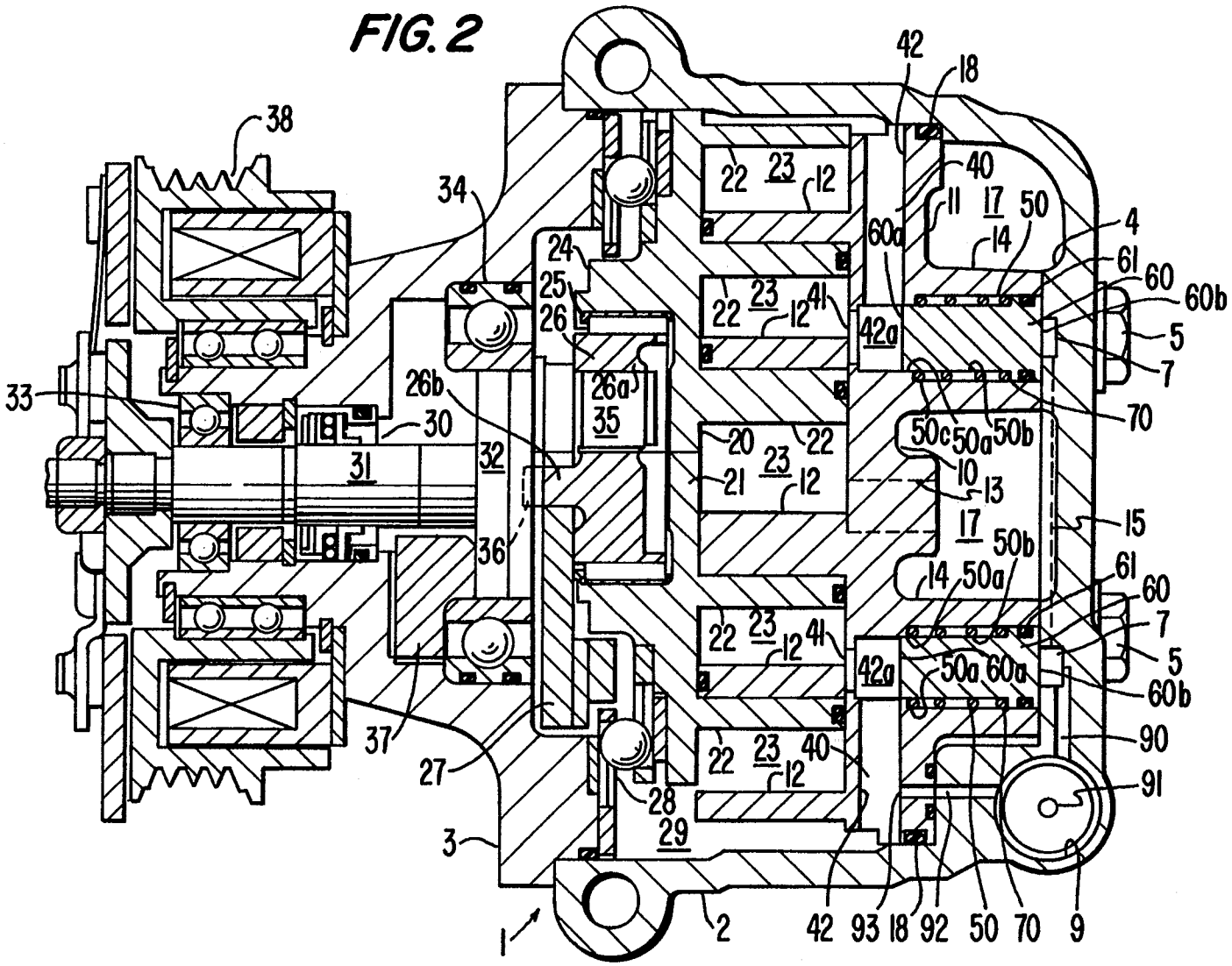
FIG. 2 is a vertical cross-sectional view of the scroll-type compressor with a variable displacement mechanism in accordance with a preferred embodiment of this invention.
Figure 3:
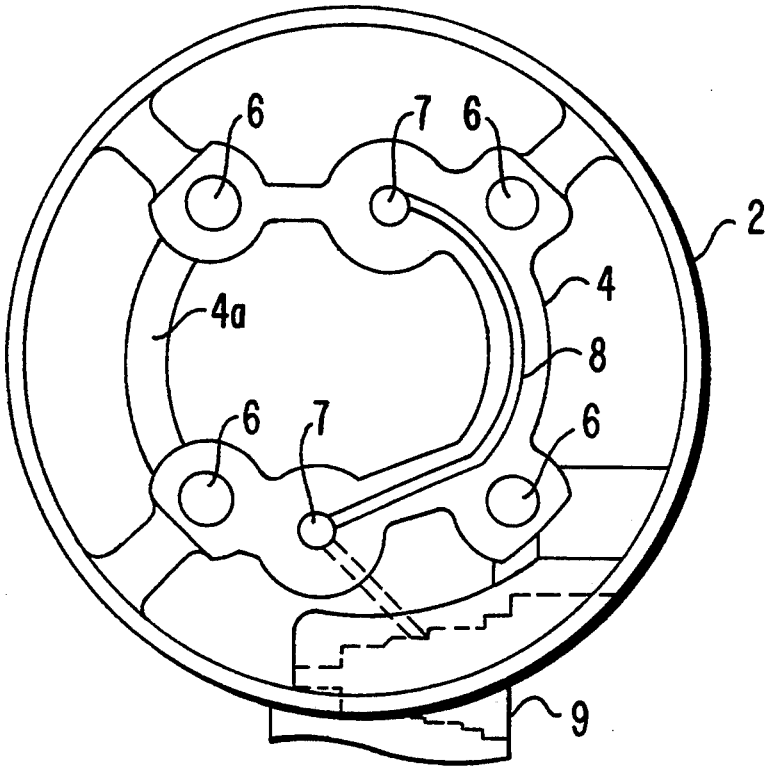
FIG. 3 is an overhead view of a cup-shaped casing of the variable displacement, scroll-type compressor depicted in FIG. 2.

Referring to FIGS. 2 and 3, a housing 1 is formed of a cup-shaped casing 2 and a funnel-shaped front end plate 3 which closes the open end of casing 2. Casing 2 is provided with a fluid inlet port 100 for introducing fluid into housing 1, and a fluid outlet port 110 for externally discharging the fluid from housing 1. Casing 2 is provided at an inner bottom surface of its one end with a nearly annular rib 4. Rib 4 is provided with four apertures 6 through which bolts 5 are inserted. Control pressure which connects control pressure passages 7 and groove 8 connecting passages 7 are formed in an upper surface of rib 4. Casing 2 is provided at its one end with an electromagnetic valve accommodation chamber 9 for accommodating a three-way electromagnetic valve (not shown), which is described below.

Figure 5:
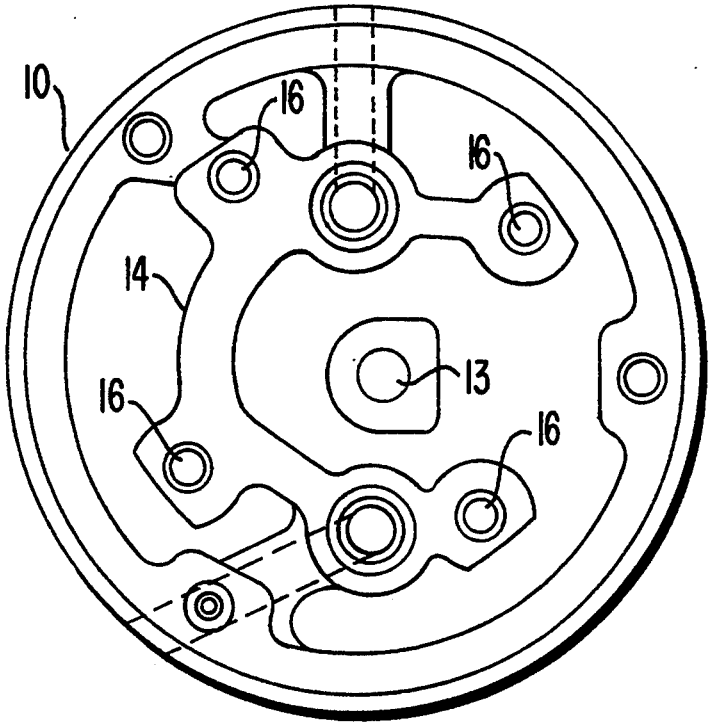
FIG. 5 is a view of the second face of a fixed scroll member of the variable displacement, scroll-type compressor depicted in FIG. 2.
Figure 4:
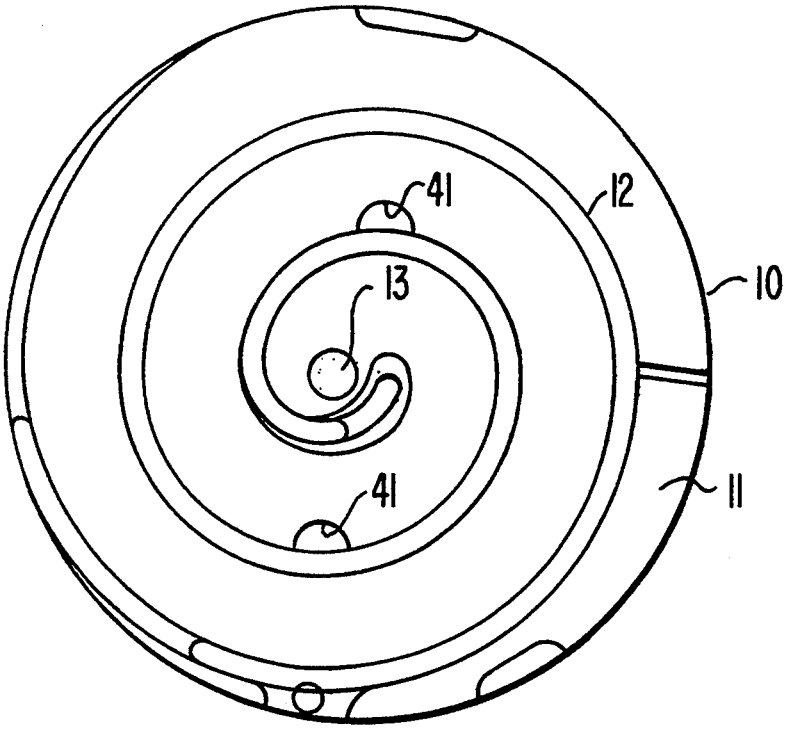
FIG. 4 is an overhead view of a fixed scroll member of the variable displacement, scroll-type compressor depicted in FIG. 2.

Referring to FIGS. 3, 4, and 5, a fixed scroll member 10 has a first plate 11 of a substantially circular shape and a first spiral element 12 formed on a first face of first plate 11. First plate 11 is provided at its central portion with a discharge port 13 and also at its second face with a C-shaped rib 14 surrounding discharge port 13. Rib 14 has a shape corresponding to that of rib 4 of casing 2, and has an end surface which contacts rib 4. Therefore, groove 8 formed in rib 4 is covered with the end surface of rib 14 to form a communication path 15 (see FIG. 2) connecting passages 7. As a result, the pressure in passages 7 is equal.

With reference to FIG. 2 in conjunction with FIG. 5, rib 14 is provided with female threaded openings 16, which engage bolts 5 inserted through apertures 6 from outside of housing 1. Thereby, fixed scroll member 10 is fixedly disposed in housing 1, and a discharge chamber 17 is formed between first plate 11 and the inner surface of casing 2. Discharge chamber 17 is in communication with discharge port 13 and the fluid outlet port 110. A seal member 18 for maintaining the air tightness of discharge chamber 17 is provided between the outer peripheral surface of first plate 11 and inner peripheral surface of casing 2.

As seen in FIG. 2, an orbiting scroll member 20 has a second plate 21 of a substantially circular shape and a second spiral element 22 formed on a first face of second plate 21. Orbiting scroll member 20 is assembled with fixed scroll member 10, so that second spiral element 22 engages first spiral element 12 with a phase deviation of 180 degrees. This engagement forms a plurality of sealed-off fluid pockets 23 between fixed scroll member 10 and orbiting scroll member 20. Second plate 21 is provided at its second face with a boss 24. A bushing 26 is disposed inside boss 24 with a needle bearing 25 therebetween. Bushing 26 has an eccentric aperture 26*a* and a pin 26*b*. Bushing 26 is also provided with counterweight 27 for canceling any centrifugal force created by orbiting scroll member 20. A rotation preventing thrust bearing mechanism 28 is disposed between second plate 21 and front end plate 3 and prevents the rotation of orbiting scroll member 20 on its axis during revolution of front end plate 3 along a substantially circular path. Fixed scroll member 10 and orbiting scroll member 20 assembled together form a space. i.e., suction chamber 29, between the inner peripheral surface of casing 2 and the outer peripheral surfaces of fixed scroll member 10 and orbiting scroll member 20. Suction chamber 29 is in communication with the fluid inlet port.

A drive shaft 30 has a small diameter portion 31 and large diameter portion 32 provided at one end of portion 31. Small diameter portion 31 is rotatably supported by ball bearings 33 disposed inside one end of front end plate 3. The large diameter portion 32 is rotatably supported by a ball bearing 34 also disposed inside the end of front end plate 3, and portion 32 is provided at an eccentric position with crank pin 35, which is inserted into eccentric aperture 26*a* in bushing 26. Thereby, drive shaft 30 and orbiting scroll member 20 are connected, so that orbiting scroll member 20 moves orbitally in accordance with the rotation of drive shaft 30. Portion 32 is also provided with an arc-shaped groove 36 for receiving pin 26*b* of bushing 26. The arc of groove 36 has a center coincident with the center line of crank pin 35. Due to the engagement of the groove 36 by pin 26*b*, the rotation of bushing 26 around crank pin 35 is restricted. Counter-weight 27 for canceling centrifugal force created by orbiting scroll member 20 is thereby attached to drive shaft 30. The end of drive shaft 30 is connected to an electromagnetic clutch 38 mounted on the other end of plate 3.

Figure 6:
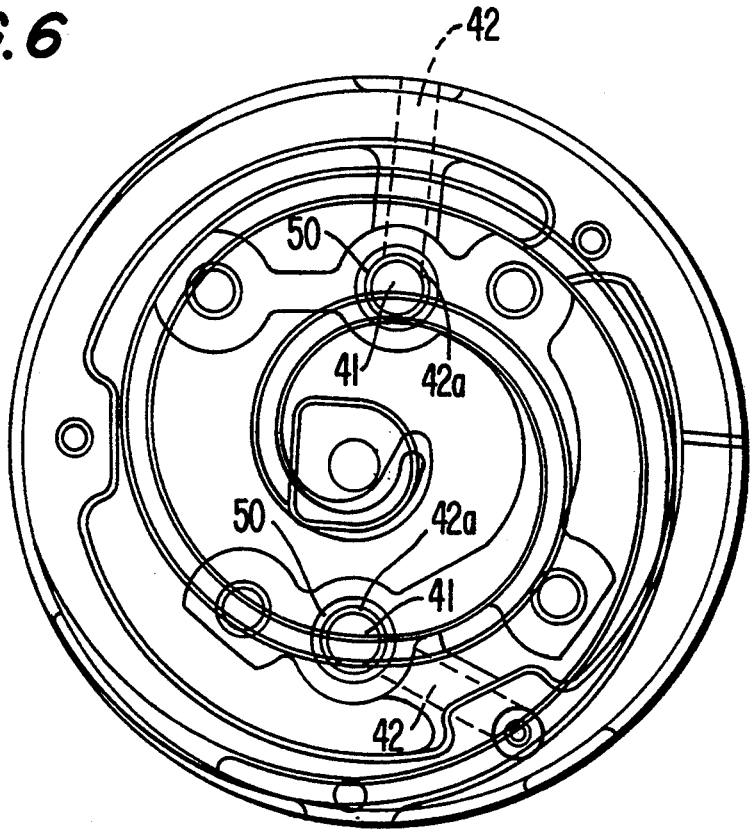
FIG. 6 is a view of the relationship between first and second faces of the fixed scroll member depicted in FIGS. 4 and 5.

Referring to FIG. 6 in conjunction with FIG. 2, bypass passages 40, by which fluid pockets 23 communicate with suction chamber 29, are formed by bypass holes 41 which are formed in first plate 11 and side bypass passages 42, which communicate with bypass holes 41. Each bypass hole 41 is parallel to the axis of drive shaft 30 (hereinafter the "axis"). Bypass holes 41 are located, so that a pair of fluid pockets 23 communicate with each of them when those pockets 23 reach the central portions of first and second spiral elements 12 and 22, i.e., are intermediately located. Side bypass passages 42 extend in radial directions to first plate 11, and each has one end **42*a* configured to receive a first axial end 60*a* of shuttle valve member 60, which is described in more detail below. The opposite end of each side bypass passage 42 is opened at the other peripheral surface of first plate 11 and is in communication with suction chamber 29**.

One or more cylinders 50, which are formed in rib 14 of first plate 11, are coaxial to bypass hole 41 and are in communication with the side bypass passage 42. Passages 7 are coaxial with bypass holes 41, and cylinders 50 are also in communication with passages 7. Each cylinder 50 has small diameter portion **50*a* and large diameter portion 50*b*. Small diameter portions 50*a* directly conform to the ends 42*a* of side bypass passages 42**.

Shuttle valve member 60 having a nearly T-shaped cross-section and a first and a second axial end **60*a* and 60*b* is slidably disposed in each cylinder 50. A seal member 61 is attached around second axial end 60*b* of each shuttle valve member 60 to ensure a fluid-tight seal in cylinder 50. Because cylinders 50 are coaxial with bypass holes 41, shuttle valve members 60 are also coaxial with the bypass holes 41. First axial end 60*a* of each shuttle valve member 60 is movable into and out of end 42*a* of side bypass passage 42. When end 60*a* of shuttle valve member 60 moves into end 42*a* of side bypass passage 42, bypass passage 40 is closed. When the end 60*a* of shuttle valve member 60 moves out of end 42*a*, bypass passage 40** is opened.

A spring 70 is disposed around each shuttle valve member 60 and is located in large diameter portion **50*b* of cylinder 50. One end of spring 70 is in contact with stepped portion 50*c* formed between small and large diameter portions 50*a* and 50*b* of cylinder 50, and the other end is in contact with the rear end of shuttle valve member 60. Thereby, spring 70 biases shuttle valve member 60 to move its end 60*a* away from end 42*a* of said bypass passage 42. Thus, spring 70 biases shuttle valve member 60 to open bypass passage 40**.

Figure 7:
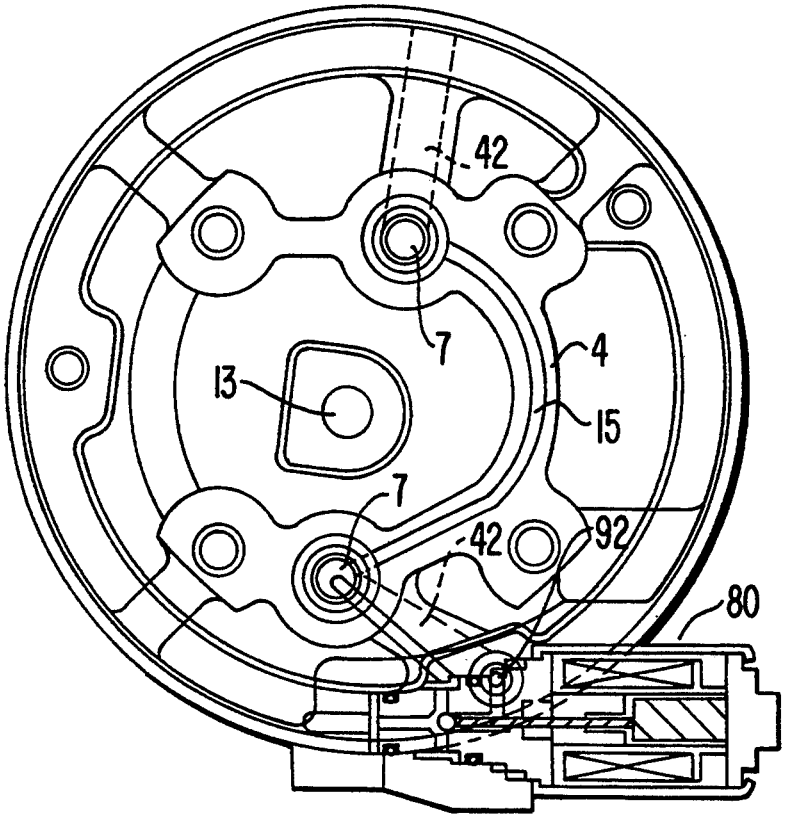
FIG. 7 is a view of the relationship between a front side of the cup-shaped casing depicted in FIG. 3 and a second face of the fixed scroll member depicted in FIG. 5.
Figures 8A, 8B:
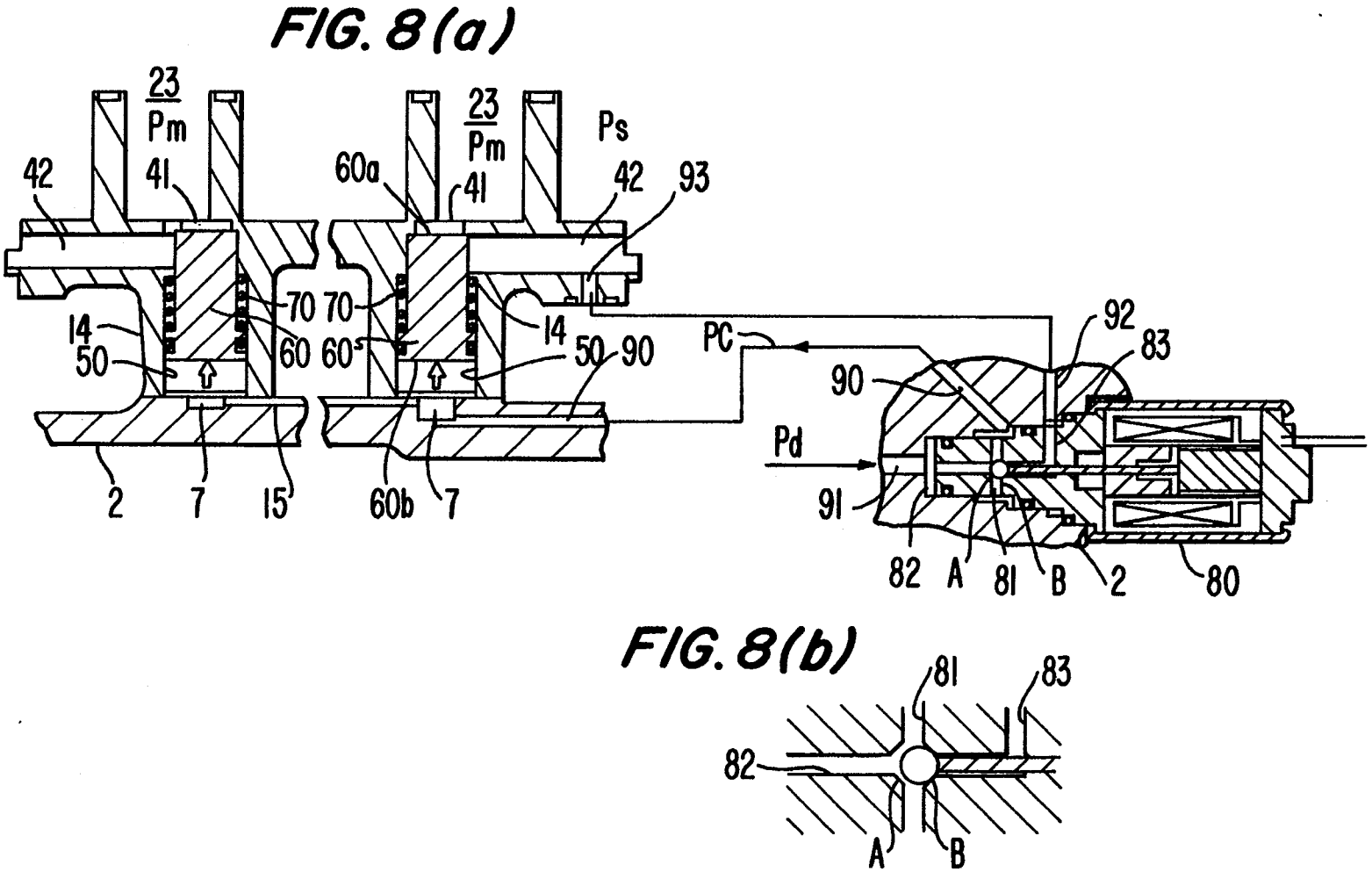
FIG. 8 is a cross-sectional view of a portion of the variable displacement, scroll-type compressor depicted in FIG. 2.
Figures 9A, 9B:
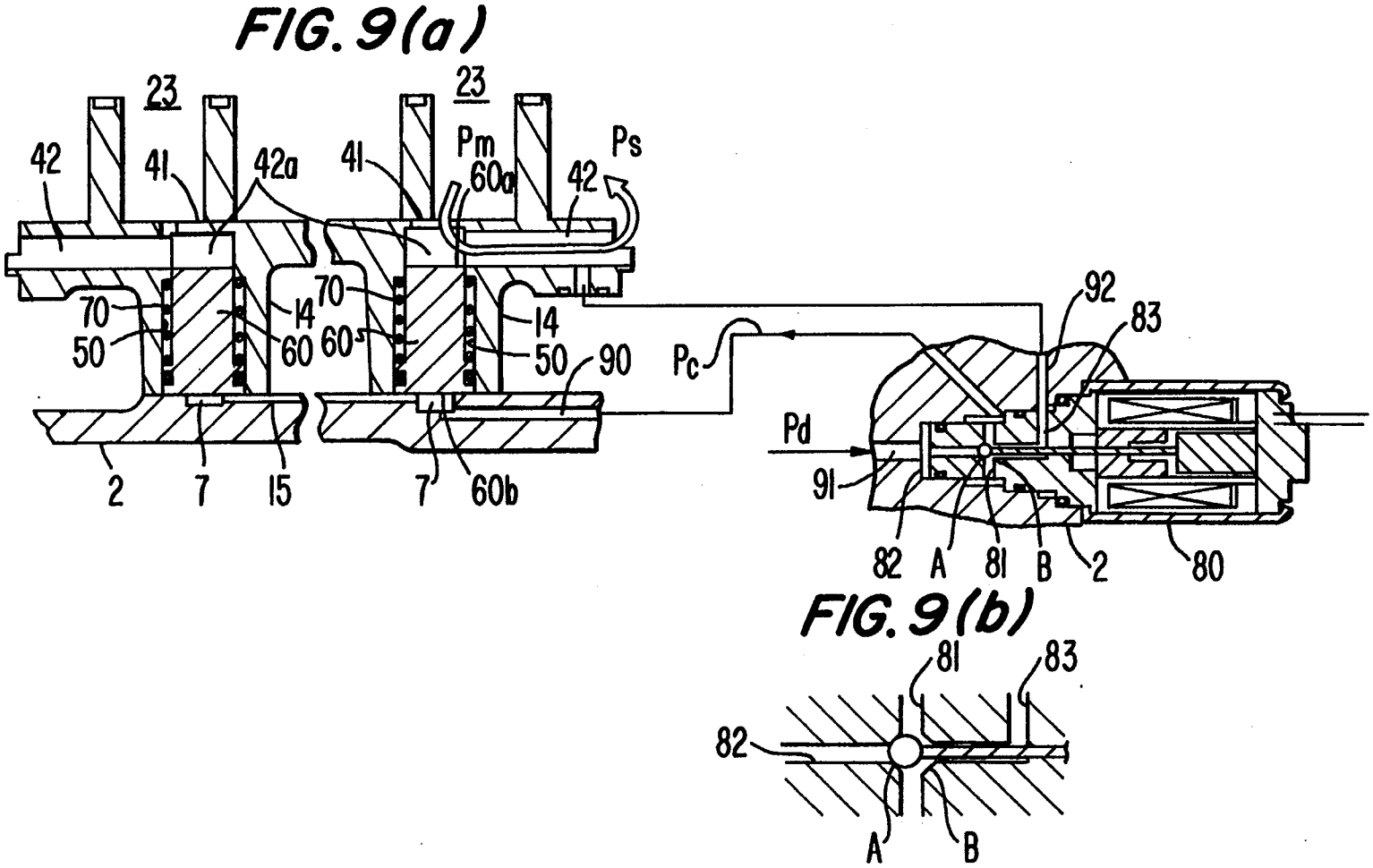
FIG. 9 is a cross-sectional view of a portion of the variable displacement, scroll-type compressor depicted in FIG. 2.

Referring also to FIGS. 7, 8, and 9, three-way electromagnetic valve 80 is disposed in the electromagnetic valve accommodating chamber 9 in casing 2. Three-way electromagnetic valve 80 has a first port 81, a second port 82, and a third port 83. Casing 2 is provided at its one end with communication passage 90 having one end communicating with first port 81 and an other end communicating with one of passages 7. Communication passage 90, passages 7, and communication path 15 form means for communicating at least two cylinders 50 to first port 81. Casing 2 is also provided at its one end with an outlet pressure passage 91 which places discharge chamber 17 in communication with second port 82. Further, as can be seen from FIG. 2, casing 2 is provided at its one end with passage 92 axially extending from electromagnetic valve accommodating chamber 9. First plate 11 is provided with passage 93 having one end communicating with passage 92 and the other end communicating with side bypass passage 42, passages 92 and 93, as well as side bypass passage 42, form a suction pressure passage communicating suction chamber 29 with third port 83.

As shown in FIGS. 8(*a*) and 8(*b*), when three-way electromagnetic valve 80 is turned off, sealing surface A is opened and sealing surface B is closed, whereby a discharge pressure fluid is introduced through outlet pressure passage 91 into second port 82. The discharge pressure fluid introduced into the second port 82 flows over sealing surface A and is introduced through first port 81 into one of passages 7, and further the fluid is introduced through communication path 15 into the other passages 7. Thereby, the discharge pressure fluid is introduced into the at least two cylinders 50, so that the discharge pressure is applied against end **60*b* of shuttle valve member 60 disposed in each cylinder 50**. Assuming that:

Pc is the control pressure introduced into cylinder 50,
Pm is the pressure of the fluid being compressed in at least two intermediately located sealed-off fluid pockets 23,
Pd is the discharge pressure,
Ps is the suction pressure, and
F is the spring force of spring 70;
p is the difference between the forces applied to opposite ends **60*a* and 60*b* of shuttle valve member 60** and is expressed as follows:

$$P=Pc-(Pm+F).$$

Meanwhile, the elements described above are designed such that $Pd>Pm+F$. When three-way electromagnetic valve 80 is turned off, Pc will equal Pd, and thus, $Pc-(Pm+F)>0$. As long as $P>0$, a force is generated biasing shuttle valve members 60 toward bypass holes 41, so that side bypass passages 42 are closed, and the compressor attains the maximum displacement driving state.

When three-way electromagnetic valve 80 is turned on in the maximum displacement driving state, sealing surface A is closed, and sealing surface g is opened, as shown in FIGS. 9(*a*) and 9(*b*), so that the first and second ports 81 and 82 are isolated from each other, and thus, passages 7 are isolated from outlet pressure passage 91. Meanwhile, first and third ports 81 and 83 are placed in communication with each other, and passage 7 and suction pressure passage are placed in communication with each other. Therefore, the discharge pressure fluid which has been introduced into each cylinder 50, escapes through passage 7, three-way electromagnetic valve 80, and suction pressure passage to suction chamber 29, so that a suction or negative pressure is applied the rear surface of each shuttle valve member 60. In this state, the relationship of the force applied to opposite ends **60*a* and 60*b* of shuttle valve member 60 can be expressed as $P=Pc-(Pm+F)$, as described above, which can be rewritten as $P=Pc-Pm-F$, and can be further rewritten as $P=(Pc-Pm)-F$. Because $Ps<Pm$, $Ps-Pm<0$. Further, because $Pc=Ps$, $Pc-Pm<0$. In this case, all the negative forces act to move shuttle valve member 60 away from bypass hole 41. Therefore, a force for moving shuttle valve member 60 away from bypass hole 41 is formed, which can be expressed as (Pc−Pm) in addition to spring force F. This is different from the prior art, and results in improved responsiveness of each shuttle valve member 60**.

Accordingly, in a variable displacement, scroll-type compressor, according to the preferred embodiment, shuttle valve member 60, which is movable to open bypass hole 41, receives at its one end 60*a* the pressure of the fluid which is being compressed in intermediately located sealed-off fluid pockets 23, i.e., Pm, in addition to the spring force F which biases shuttle valve member 60, so that shuttle valve member 60 has the superior responsiveness as compared to prior art designs and thus, the responsiveness in the displacement controlling operation of the compressor is improved.

Further, in such a variable displacement, scroll-type compressor, spring 70 biasing shuttle valve member 60 is disposed in cylinder 50 without protruding into bypass hole 41. Therefore, the pressure loss caused by the fluid resistance of spring 70 in the fluid in bypass hole 41 is eliminated, so that the minimum displacement can be better obtained.

Although a detailed description of the present invention has been provided above, it is to be understood that the scope of the invention is not to be limited thereby, but is to be determined by the claims which follow.

I claim:

1. A variable displacement, scroll-type compressor comprising:

a housing having a fluid inlet port and a fluid outlet port;

a fixed scroll member having a first plate and a first spiral element extending from a first face of said first plate, said fixed scroll member being fixedly disposed in said housing a discharge port formed at a central portion of said first plate;

an orbiting scroll member having a second plate and a second spiral element extending from a first face of said second plate, such that said first spiral element engages said second spiral element to form a plurality of sealed-off fluid pockets having variable volumes;

a driving mechanism to effect an orbital motion of said orbiting scroll member and a rotation-preventing mechanism for preventing said orbiting scroll member from rotating during its orbital motion, whereby the volumes of said sealed-off fluid pockets change during said orbital motion of said orbiting scroll member;

a suction chamber formed between an outer peripheral surface formed by said fixed scroll member and said orbiting scroll member and an inner peripheral surface of said housing, said suction chamber communicating with said fluid inlet port;

a discharge chamber placing said discharge port in communication with said fluid outlet port;

a pair of bypass passages for selectively placing a pair of corresponding, intermediately located sealed-off fluid pockets in communication with said suction chamber;

a pair of cylinders, each of which is formed within a projection from said fixed scroll member;

at least one valve member corresponding to each of said bypass passages and having a first axial end and a second axial end slidably disposed within one of said pair of cylinders for closing and opening one of said bypass passages, said at least one valve member receiving fluid pressure from one of said sealed-off fluid pockets at said first axial end thereof;

a pair of elastic members, each of which is located solely within one of said cylinders and biases said at least one valve member to open said corresponding bypass passage;

communication control means for selectively controlling a first communication passage between said suction chamber and a cavity defined by said second axial end of each of said at least one valve member and said cylinder in which said at least one valve member is disposed; and a second communication passage between said discharge chamber and said cavity; wherein said projection is an axial projection from a second face of said first plate, said projection comprising an end surface contacting an inner bottom end surface of said housing; each of said pair of cylinders formed in said projection; and a communication path linking cavities of each of said cylinders, said communication path formed between said end surface of said projection and said inner bottom end surface of said housing.

2. The scroll-type compressor of claim 1 wherein said communication path comprises a groove formed in said inner bottom end surface of said housing and covered by said end surface of said projection.

3. The scroll-type compressor of claim 2 wherein said communication control means comprises a three-way electromagnetic valve.

4. A variable displacement, scroll-type compressor comprising:

a housing having a fluid inlet port and a fluid outlet port;

a fixed scroll member having a first plate and a first spiral element extending from a first face of said first plate, said fixed scroll member being fixedly disposed in said housing;

a discharge port formed at a central portion of said first plate;

an orbiting scroll member having a second plate and a second spiral element extending from a first face of said second plate, such that said first spiral element engages said second spiral element to form a plurality of sealed-off fluid pockets having variable volumes:

a driving mechanism to effect an orbital motion of said orbiting scroll member and a rotation-preventing mechanism for preventing said orbiting scroll member from rotating during its orbital motion, whereby the volumes of said sealed-off fluid pockets change during said Orbital motion of said orbiting scroll member;

a suction chamber formed between an outer peripheral surface formed by said fixed scroll member and said orbiting scroll member and an inner peripheral surface of said housing, said suction chamber communicating with said fluid inlet port;

a discharge chamber placing said discharge port in communication with said fluid outlet port;

at least one bypass passage for selectively placing at least one sealed-off fluid pocket in communication with said suction chamber;

at least one cylinder formed within a projection from said fixed scroll member;

at least one valve member corresponding to said at least one bypass passage and having a first axial end and a second axial end slidably disposed within said at least one cylinder for closing and opening said at least one bypass passage, said at least one valve member receiving fluid pressure from said at least one sealed-off fluid pocket at said first axial end thereof an elastic member biasing said at least one valve member to open said at least one bypass passage, said elastic member located solely within said cylinder;

communication control means for selectively controlling a first communication passage between said suction chamber and a cavity defined by said second axial end of said valve member and said at least one cylinder; and a second communication passage between said discharge chamber and said cavity; wherein said projection is an axial projection from a second face of said first plate, said projection comprising an end surface contacting an inner bottom end surface of said housing; said at least one cylinder formed in said projection; and a communication path linking said cavity of each of said at least one cylinder, said communication path formed between said end surface of said projection and said inner bottom end surface of said housing.

5. The scroll-type compressor of claim 4 wherein said communication path comprises a groove formed in said inner bottom end surface of said housing and covered by said end surface of said projection.

6. The scroll-type compressor of claim 5 wherein said communication control means comprises a three-way electromagnetic valve.

7. A variable displacement, scroll-type compressor comprising:

a housing having a fluid inlet port and a fluid outlet port;

a fixed scroll member having a substantially circular first plate and a first spiral element extending from a first face of said first plate, said fixed scroll member being fixedly disposed in said housing;

a discharge port formed at a central portion of said first plate;

an orbiting scroll member having a substantially circular second plate and a second spiral element extending from a first face of said second plate, such that said first spiral element engages said second spiral element to form a plurality of sealed-off fluid pockets having variable volumes;

a driving mechanism to effect an orbital motion of said orbiting scroll member and a rotation-preventing mechanism for preventing said orbiting scroll member from rotating during its orbital motion, whereby the volumes of said sealed-off fluid pockets change during said orbital motion of said orbiting scroll member;.

a suction chamber formed between an outer peripheral surface formed by said fixed scroll member and said orbiting scroll member and an inner peripheral surface of said housing, said suction chamber communicating with said fluid inlet port;

a discharge chamber placing said discharge port in communication with said fluid outlet port;

a pair of bypass passages for selectively placing a pair of intermediately located sealed-off fluid pockets in communication with said suction chamber;

a pair of cylinders, each of which is formed within a projection from said fixed scroll member;

a pair of valve members, each of which is slidably disposed within one of said pair of cylinders for closing and opening said bypass passage, having a first axial end and a second axial end, each of said valve members receiving fluid pressure from one of said sealed-off fluid pockets at said valve member's first axial end;

a pair of springs, each of which biases one of said valve members to open one of said bypass passages, each of said springs located solely within one of said pair of cylinders;

a three-way electromagnetic valve for selectively controlling a first communication passage between said suction chamber and a cavity defined by said second axial end of each of said valve members and said cylinder in which said valve member is disposed; and a second communication passage between said discharge chamber and said cavity; wherein said projection is an axial projection from a second face of said first plate, said projection comprising an end surface contacting an inner bottom end surface of said housing; each of said pair of cylinders formed in said projection; and a communication path linking said cavities of each of said pair of cylinders, said communication path formed between said end surface of said projection and said inner bottom end surface of said housing.

8. The scroll-type compressor of claim 7 wherein said communication path comprises a groove formed in said inner bottom end surface of said housing and covered by said end surface of said projection.

* * * * *